United States Patent [19]

Parker

[11] Patent Number: 4,661,279

[45] Date of Patent: Apr. 28, 1987

[54] DETERGENT COMPOSITION

[75] Inventor: Edward J. Parker, Riverview, Mich.

[73] Assignee: BASF Corporation, Wyandotte, Mich.

[21] Appl. No.: 800,797

[22] Filed: Nov. 22, 1985

[51] Int. Cl.[4] ..... C11D 3/395; C11D 7/54

[52] U.S. Cl. ..... 252/94; 252/173; 252/174.21; 252/174.22; 252/187.23; 252/187.24; 252/187.25; 252/187.26; 252/DIG. 1; 252/DIG. 14

[58] Field of Search ..... 252/174.21, 174.22, 252/187.23, 187.24, 187.25, 187.26, DIG. 1, 173, DIG. 14, 94; 568/609

[56] References Cited

U.S. PATENT DOCUMENTS

| | | | |
|---|---|---|---|
| 2,723,241 | 11/1955 | Groote | 568/609 |
| 3,172,861 | 3/1965 | Steinhauer et al. | 252/187.26 |
| 4,256,601 | 3/1981 | Sobata et al. | 252/174.21 |
| 4,450,304 | 5/1984 | Diery et al. | 568/609 |
| 4,470,914 | 9/1984 | Thir et al. | 568/609 |

FOREIGN PATENT DOCUMENTS

| | | |
|---|---|---|
| 23540 | 8/1970 | Japan . |
| 14986 | 1/1984 | Japan . |

*Primary Examiner*—Paul Lieberman
*Assistant Examiner*—Hoa Van Le
*Attorney, Agent, or Firm*—Bernhard R. Swick

[57] ABSTRACT

The instant invention relates to a composition comprising a Bisphenol initiated polyoxyalkylene compound, a chlorine releasing compound and water.

The Bisphenol initiated alkylene oxide compound is believed to be a cogeneric mixture of polymers denominated by the following formula

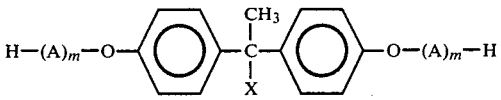

(I)

Wherein A comprises oxyethylene and $C_3$–$C_5$ oxyalkylene groups to form either a heteric or block copolymer; m is a whole number selected to give an overall average molecular weight of the product of 1100 to 15,000, and X is $CH_3$ or $C_2H_5$.

The preferred compounds are oxyalkylated Bisphenol block copolymers believed to be a cogeneric mixture of polymers denominated by the following formulas:

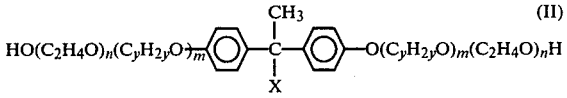

(II)

and

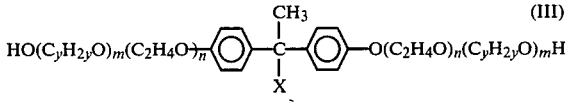

(III)

Wherein X is $CH_3$ or $CH_2H_5$, y is 3 or 4, m and n are whole numbers selected to give an overall molecular weight from about 1100 to 15,000 and a percent of oxyethylene groups from about 10 to 9. This composition has varied uses as a fabric cleaner with bleaching properties and a warewashing composition having a minimum of odor problems. Accordingly, in addition to the above components the invention relates to compositions which may be also contain conventional ingredients for such compositions.

23 Claims, No Drawings

DETERGENT COMPOSITION

BACKGROUND OF THE INVENTION

This invention relates to chlorine-stable detergent compositions containing nonionic surfactants and to a process for the preparation thereof.

Active chlorine containing compounds such as sodium hypochlorite have been widely used for bleaching fabrics, sterilizing in commercial warewashing, and deodorizing in hard surfaces cleaners. Because solid compounds particularly sodium hypochlorite are unstable and can decompose violently, they are commonly used as an aqueous solution. However, a sodium hypochlorite solution will decompose slowly over a period of time. Addition of a surfactant generally accelerates this decomposition, resulting in loss of stability and efficacy. While some surfactants with enhanced chlorine stability are known, for example. those disclosed in U.S. Pat. No. 4,071,463 and U.S. Pat. No. 4,174,289 these are all anionic types which are generally high foaming surfactants.

For many applications nonionic surfactants are much more suitable since there are many nonionic surfactants available which are low foaming surfactants. However, heretofore, much difficulty has accompanied the preparation of detergent compositions comprising both an active chlorine-containing compound and a nonionic surfactant because of the interaction which generally occurs between the two. This interaction generally results in discoloration and degradation of the detergent composition with an accompanying loss in the available chlorine content of the composition. Since a nonionic surfactant possesses wetting properties and an active chlorine compound possesses bleaching, cleaning and sanitizing properties, it is desirable to have both compounds present in detergent compositions.

Several attempts have been made to prepare a detergent composition containing both a chlorine compound and a nonionic surfactant but heretofore all have failed for one reason or another. For example, U.S. Pat. No. 2,895,916 relates to a process for the preparation of detergent compositions containing an active chlorine compound. Disclosed is the use of a nonionic surfactant in the preparation of the compositions. It has now been found that although detergent compositions containing an active chlorine compound and a nonionic surfactant may be prepared according to the process of this patent, the compositions are not stable with respect to the active chlorine content; that is, within a very short time the starting available chlorine content decreases to such an extent that for all practical purposes the detergent compositions are chlorine-free.

Accordingly it is a purpose of the instant invention to provide a chlorine stable detergent composition containing nonionic surfactant.

Additional Background Patents

| Patent No. | Issued | Inventor(s) | Assignee |
|---|---|---|---|
| 4,507,219 | 3/26/85 | Hughes P & G | |
| 4,438,016 | 3/20/84 | Kiewert | Henkel |
| 4,329,247 | 5/11/82 | Parmer PDI Inc. | |
| 4,510,067 | 4/9/85 | Ozmeral | BASF Wyandotte |
| 3,359,207 | 12/19/67 | Kaneko at el | BASF Wyandotte |

SUMMARY OF THE INVENTION

The instant invention relates to a composition comprising a Bisphenol initiated polyoxyalkylene compound, a chlorine releasing compound and water. This composition has varied uses as a fabric cleaner with bleaching properties, a warewashing composition having sterilization properties and a variety of cleaners having a minimum of odor problems. Accordingly, in addition to the above components the invention relates to compositions which may also contain conventional ingredients for such compositions.

DETAILED DESCRIPTION OF THE PREFERRED EMBODIMENTS

The Bisphenol initiated compound employed in the composition of this invention is a cogeneric mixture of conjugated polyoxyalkylene compounds containing in their structure, $C_3$ to $C_5$ oxyalkylene groups, oxyethylene groups and the nucleus of a Bisphenol compound originally containing a pair of reactive hydrogen atoms. The compounds may be heteric or block and are characterized in that the oxyalkylene groups which are attached to the Bisphenol compound at the site of the reactive hydrogen atoms.

In one preferred embodiment, the $C_3$–$C_5$ oxyalkylene groups are present in chains that are attached to the Bisphenol compound at the site of the reactive hydrogen atoms, therefore constituting a $C_3$–$C_5$ polyoxyalkylene polymer, the oxyethylene groups being attached to the $C_3$–$C_5$ polyoxyalkylene polymer in polyoxyethylene chains. In another preferred embodiment the polyoxyethylene groups are present in polyoxyethylene chains that are attached to the Bisphenol nucleus at the site of the reactive hydrogen atoms thereby constituting a polyoxyethylene polymer; with the $C_3$–$C_5$ oxyalkylene groups being attached to the polyoxyethylene polymer in $C_3$–$C_5$ polyoxyalkylene chains. In a third preferred embodiment, the oxyalkylene groups are a heteric mixtures of $C_3$–$C_5$ oxyalkylene groups with oxyethylene groups.

The alkylene oxide compound is prepared by reacting in the presence of a base catalyst a Bisphenol compound with the alkylene oxides. The alkylene oxides may be a mixture or the Bisphenol may be reacted first with one alkylene oxide, then the other, such as for example reaction first with the $C_3$–$C_5$ alkylene oxide followed by reaction with ethylene oxide. The Bisphenol may alternatively be reacted first with ethylene oxide followed by the $C_3$–$C_5$ alkylene oxide depending on which product is desired. The method of preparation of a reaction product of Bisphenol with propylene oxide and ethylene oxide or butylene oxide and ethylene oxide is well known to those skilled in the art and need not be described here. Bisphenol A is the preferred initiator compound and is well known to those skilled in the art as 4,4'-isopropylidenediphenol. Bisphenol B may also be employed which is known to those skilled in the art as p,p'-sec-butylidenediphenol. Any of the conventional catalysts employed for oxyalkylation may be employed such as potassium hydroxide, sodium hydroxide, boron trifluoride dietherate and any metal oxide.

In a preferred embodiment, generally at least a portion of the Bisphenol compound is reacted with a portion of $C_3$–$C_5$ oxide or the ethylene oxide or mixture of both in a conventional manner to produce a Bisphenol component which is a liquid. The amount of said alkylene oxide may range from 1 to 10 moles per mole of Bisphenol compound. This small amount is employed in order to have a liquid in which to carry out the reaction after which additional Bisphenol compound as well as the alkylene oxides may be added to the reaction mixture to produce the final product. The initial reaction mixture contains by weight about 1 to 95 percent of the total amount of Bisphenol component, about 0.1 to 5 percent by weight catalyst and about 1 to 10 moles of alkylene oxide per mole of Bisphenol compound. The mixture is heated to a temperature of from about 100° to 135° C. After stripping for about 15 to 60 minutes at a temperature of about 95° to 125° C. at a pressure of less than 10 millimeters of mercury, the vacuum is relieved to about 0 to 5 psig with nitrogen and the remaining alkylene oxides added over a period of about 1 to 12 hours.

The reaction then proceeds until a constant pressure is observed which requires from about one to four hours. As previously stated the ethylene oxide and $C_3$–$C_5$ higher alkylene oxide may be a mixture or may be reacted sequentially with either the higher alkylene oxide added first followed by the ethylene oxide or vice versa. The ratios of the alkylene oxides and the Bisphenol component will depend on the ultimate product desired. For purposes of the instant invention, it is preferred to employ an alkoxylated Bisphenol product having an overall molecular weight of about 1100 to 15,000 preferably about 1900 to 9000 containing about 10 to 90 percent preferably about 10 to 40 percent oxyethylene groups.

The product produced by the reaction of the Bisphenol compound with the alkylene oxides is believed to be a cogeneric mixture of polymers denominated by the following formula

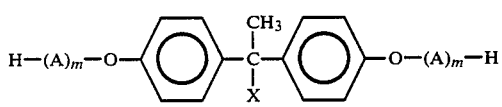

(I)

Wherein A comprises oxyethylene and $C_3$–$C_5$ oxyalkylene groups to form either a heteric or block copolymer; m is a whole number selected to give an overall average molecular weight of the product of 1100 to 15,000, preferably 1900 to 9000, and X is $CH_3$ or $C_2H_5$.

In a preferred embodiment of the invention, A comprises a heteric mixture of oxyethylene groups and groups selected from oxypropylene and oxybutylene. In another preferred embodiment the oxyethylene groups are attached to an oxygen that is attached to a phenyl group and the oxypropylene or oxybutylene groups are attached to the opposite ends of the oxyethylene groups. In still another preferred embodiment, A comprises oxyethylene groups and groups selected from oxypropylene and oxybutylene groups wherein said oxypropylene or oxybutylene groups are attached to the oxygen that in turn is attached to a phenyl group and the oxyethylene groups are attached to the opposite end of the oxypropylene or oxybutylene groups. The total molecular weight of the final product is from about 1100 to 15,000 preferably about 1900 to 4000. The percentage of oxyethylene groups in these compounds is from about 10 to 90, preferably about 10 to 40. The preferred oxyalkylated Bisphenol block copolymers employed in the instant invention is believed to be a cogeneric mixture of polymers denominated by the following formulas:

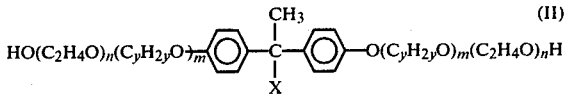

(II)

and

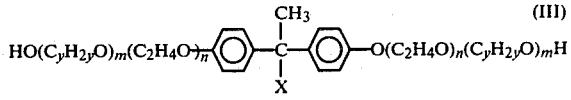

(III)

Wherein X is $CH_3$ or $C_2H_5$, y is 3 or 4, m and n are whole numbers selected to give an overall molecular weight from about 1100 to 15,000 preferably about 1900 to 9000, and a percent of oxyethylene groups from about 10 to 90, preferably about 10 to 40. The oxybutylene chains optionally but advantageously contain small amounts of oxyethylene and oxypropylene groups, the oxypropylene chains optionally, but advantageously, contain small amounts of oxyethylene and oxybutylene groups and the oxyethylene chains also optionally, but advantageously, contain small amounts of oxypropylene and oxybutylene groups. These compositions are generally described in the U.S. Pat. Nos. 2,677,700, 2,674,619, and 2,979,528. The term "cogeneric mixture" used herein is a term that has been coined to designate a series of closely related touching homologues that are obtained by condensing a plurality of alkylene oxide units with a reactive hydrogen compound (see U.S. Pat. No. 2,549,438, particularly the sections beginning at column 12, line 40). This expression is well known to those skilled in the art as can be seen from U.S. Pat. Nos. 2,677,700; 2,674,619; and 2,979,528.

Active chlorine containing compounds which may be employed in accordance with the instant invention include chlorinated trisodium phosphate, trichlorocyanuric acid, sodium salt of dichlorocyanuric acid, potassium salt of dichlorocyanuric acid, sodium hypochlorite, potassium hypochlorite and 1,3-dichloro-5,5-dimethylhydantoin. The three component composition of the invention which comprises a Bisphenol initiated compound, chlorine releasing compound and water is useful for various cleaning, bleaching and sterilizing applications. Such three component composition to be used as is or mixed with other ingredients comprises from about 1.0 to 15 percent, preferably about 1.0 to 5.0 percent Bisphenol initiated compound, about 1.0 to 10 percent, preferably about 1.0 to 5.0 percent chlorine releasing compound and about 75 to 98 percent, preferably about 90 to 98 percent water.

Normally these three components would be formulated with other ingredients or additives depending upon the use of the ultimate product, i.e., whether for cleaning fabrics, for warewashing, for hard surface cleaners or other uses. For purpose of describing the instant invention any other components which might be present with the above three are referred to herein as additives throughout the specification and claims. The manner of using these components by incorporating in a dishwashing, laundry, hard surface or other detergent composition is well known to those skilled in the art. Such other ingredients include other surfactants, which may be anionic or cationic, builders, bleaches, abrasives, fillers, dyes, perfumes, soil anti-redeposition agents, optical brighteners, hydrotropes, etc. An important component of cleaning compositions particularly automatic dishwashing detergents are the builders or builder salts such as an alkaline condensed phosphate salt, for instance, tetrasodium pyrophosphate and those polyphosphates of the calcium and magnesium ion sequestering type whose $Na_2O/P_2O_5$ ratios range from 1:1 to 1.67:1 and 20 to 80 weight percent of an alkaline detergent salt such as sodium carbonate, sodium bicarbonate and mixtures thereof, di- and trisodium orthophosphate, sodium metasilicate, sodium sesquisilicate, borax and sodium borate.

Alternatively to the use of phosphate builders, any of the water-soluble metal salts of citric acid can be used in the practice of the present invention. However all salts do not serve with equal effectiveness, and the alkali metal salts, particularly the sodium and potassium citrates. are preferred. Suitable proportions of silicates in dishwashing formulations are employed to overcome certain difficulties. The silicate used is preferably solid granular sodium metasilicate, a commercially available material. Sodium silicates in which the mole ratio of $SiO_2$:$Na_2O$ are more than 1:1. e.g., 2:1 or 3:1, may be used in place of the sodium metasilicate.

The combination of the citrate and condensed phosphate salt (e.g., sodium tripolyphosphate) appears to result in an enhanced activity.

Preferred over all cleaning compositions will comprise from about 10 to 15 percent preferably about 1.0 to 5.0 percent Bisphenol initiated polyoxyalkylene copolymer, about 1.0 to 10 percent, preferably about 1.0 to 5.0 percent chlorine releasing compound, up to about 60 percent, preferably about 5.0 to 30 percent additives and about 15 to 98 percent, preferably about 40 to 90 percent water. In any event, the ratio of Bisphenol initiated compound to chlorine releasing compound should range from about 1:10 to 10:1 and preferably from about 1:3 to 3:1.

When used for washing purposes in either a dishwashing or laundry solution such solution may contain about 0.1 to 0.5 and preferably about 0.15 to 0.30 percent by weight of the total detergent composition, balance water.

The examples which follow illustrate in more detail the practice of the instant invention. Unless otherwise indicated all temperatures are in degrees Centigrade and all parts, percentages, etc. are by weight throughout this application and claims.

EXAMPLES 1-5

Five three-component mixtures were prepared comprising two percent sodium hypochlorite one percent of the surfactant shown in Table I below, balance water. The five formulations were stored at 90° F. and monitored for available chlorine level each day by ASTM test method. D2022-64 (Reapproved 1980).

When the percent available chlorine was half the value of the original fresh composition the number of days to reach this point was recorded. This is set forth in Table I below under the column headed "Bleach Half-Life (days)."

TABLE I

| Example No. | Surfactant | Bleach Half-Life (days) |
|---|---|---|
| 1 | 1 | 5 |
| 2 | 2 | 12 |
| 3 | 3 | 10 |
| 4 | 4 | 13 |
| 5 | 5 | 10 |

In the above table nonionic No. 1 is a block copolymer which is a polyoxyethylene adduct of a polyoxypropylene glycol having a central polyoxypropylene chain and polyoxyethylene chains on each end thereof. Such compositions are described in U.S. Pat. Nos. 2,677,700, 2,674,619 2,979,528 the molecular weight of the polyoxypropylene hydrophobe is about 1750 and the copolymer contains about 10 percent by weight oxyethylene groups.

Surfactant No. 2 is a Bisphenol A initiated polyoxypropylene polyoxyethylene block copolymer of the type shown in formula II above having a molecular weight of the hydrophobe of about 1750, a total molecular weight of about 2000 and containing 10 percent by weight oxyethylene groups.

Surfactant No. 3 is a Bisphenol A initiated polyoxypropylene polyoxyethylene block copolymer of the type shown in formula II above having a molecular weight of the hydrophobe of about 2300, a total molecular weight of about 2600 and containing 10 percent by weight oxyethylene groups.

Surfactant No. 4 is a Bisphenol A initiated heteric oxyethylene/oxypropylene copolymer of the type shown in formula I above having a total molecular weight of 1800 and an ethylene oxide:propylene oxide weight ratio of 25:75.

Surfactant No. 5 is an anionic surfactant sold under the trademark Dowfax 3B2 which is sodium n-decyl diphenyloxide disulfonate.

The superiority of the Bisphenol A initiated copolymers over the most closely related nonionic copolymer in terms of sodium hypochlorite stability is clearly shown in the above Table. More specifically, surfactant No. 1 and surfactant No. 2 are essentially the same nonionic copolymer with the exception that surfactant No. 1 is propylene glycol initiated whereas surfactant No. 2 is a Bisphenol A initiated copolymer. From the Table it can be seen that the bleach half-life of the Bisphenol A initiated copolymer is more than twice that of the propylene glycol initiated copolymer. Example 3 demonstrates that similar results are obtained with a similar Bisphenol A initiated polyoxyalkylene block copolymer having a higher molecular weight for the hydrophobe. Example 4 demonstrates that a heteric Bisphenol A polyoxyalkylene copolymer is also effective. Example 5 demonstrates that the Bisphenol A initiated nonionics of the instant invention have a bleach half-life as good or better than the commercial anionic surfactant. The nonionics have advantages for many purposes over an anionic surfactant and the ones tested are particularly effective in that they are low foaming surfactants.

EXAMPLE 6

Example 2 is repeated with the exception that the surfactant is a Bisphenol A initiated polyoxyethylene polyoxypropylene block copolymer of the type shown in formula III above. Results similar to Example 2 are obtained.

EXAMPLE 7

Example 2 is repeated with the exception that the surfactant employed is a Bisphenol A initiated polyoxybutylene polyoxyethylene block copolymer the type shown in formula II above having a total molecular weight of about 1300 and containing 10 percent by weight oxyethylene groups. Results similar to Example 2 are obtained.

EXAMPLES 8 THROUGH 13

Six aqueous solutions were prepared consisting of five percent of the surfactant indicated in Table II below, an amount of sodium hypochlorite sufficient to provide three percent available chlorine and one weight percent sodium hydroxide. In addition the composition of Examples 8 and 9 included, respectively, 3.9 percent and 3.1 percent of a hydrotrope which was sodium 2-ethylhexyl sulfate sold under the tradename Witcolate D-510. This was added in order to solublize the surfactant. Each of these compositions was stored for 19 days at 105° F. The percent chlorine was determined at the end of the 19 days by the method described above for Example 1–5. The percentages of the chlorine in the original composition retained after the 19 days are shown in Table II below.

TABLE II

| Example No. | Surfactant | Percent Chlorine Retained |
|---|---|---|
| 8 | 1 | 0 |
| 9 | 2 | 34 |
| 10 | 6 | 25 |
| 11 | 7 | 44 |
| 12 | 8 | 53 |
| 13 | 9 | 68 |

In the above examples surfactant No. 6 was a propylene glycol initiated polyoxypropylene polyethylene block copolymer having a molecular weight of the polyoxypropylene hydrophobe of about 1750 and containing 40 percent by weight oxyethylene groups.

Surfactant No. 7 was a Bisphenol A initiated polyoxypropylene polyoxyethylene block copolymer the type shown in formula II above having a molecular weight of the hydrophobe of about 1750, a total molecular weight of about 2900 and containing 40 percent oxyethylene groups.

Surfactant No. 8 was a propylene glycol initiated polyoxypropylene polyoxyethylene block copolymer having a polyoxypropylene hydrophobe molecular weight of about 1750 containing 80 percent by weight oxyethylene groups.

Surfactant No. 9 was a Bisphenol A initiated polyoxypropylene polyoxyethylene block copolymer of the type shown in formula II above having a molecular weight of the hydrophobe of about 1750 a total molecular weight of about 8400 and containing 80 percent by weight oxyethylene groups.

As pointed out above, surfactant No. 1 and surfactant No. 2 differ only in that surfactant No. 1 is a propylene glycol initiated block copolymer and surfactant No. 2 is a Bisphenol A initiated block copolymer. Similarly surfactants Nos. 7 and 9 differ from surfactants Nos. 6 and 8, respectively, only in the different initiator employed, that is to say surfactants 7 and 9 employed Bisphenol A initiator where as 6 and 8 employ a propylene glycol initiator. It can be seen from Table II that in each case the Bisphenol A initiated copolymer had a greater percentage chlorine retention than the similar propylene glycol initiated copolymer.

EXAMPLE 10

A detergent composition is prepared consisting of by weight 9 percent surfactant No. 2, 2.0 percent sodium hypochlorite, 4 percent tetrasodium pyrophosphate, 10 percent linear alkylbenzene sulfonate, and 75 percent water.

A washing solution for laundry purposes is prepared by mixing this detergent composition with water in amount of 0.15 percent by weight of the detergent composition balance water. This washing solution is characterized by low foaming good bleaching and good cleaning properties when used in an automatic washing machine.

The embodiments of the invention in which an exclusive privilege or property is claimed are defined as follows:

1. An aqueous bleaching and cleaning composition comprising water, a chlorine releasing compound, an oxyalkylene compound which is a cogeneric mixture of conjugated polyoxyalkylene compounds containing in their structure $C_3$–$C_5$ oxyalkylene groups, oxyethylene groups and the nucleus of a Bisphenol compound originally containing a pair of reactive hydrogen atoms wherein said $C_3$–$C_5$ oxyalkylene groups and oxyethylene groups are present in chains that are attached to the bisphenol nucleus at the sites of both reactive hydrogen atoms.

2. The composition of claim 1 wherein said $C_3$to $C_5$ oxyalkylene groups are oxypropylene groups.

3. The composition of claim 1 wherein said $C_3$ to $C_5$ oxyalkylene groups are oxybutylene groups.

4. The composition of claim 1 comprising about 1.0 to 15 percent of said oxyalkylene compound about 1.0 to 10 percent of said chlorine releasing compound and about 75 to 98 percent water.

5. The composition of claim 4 wherein said $C_3$to $C_5$ oxyalkylene groups are oxyethylene groups.

6. The composition of claim 4 wherein said $C_3$to $C_5$ oxyalkylene groups are oxybutylene groups.

7. The composition of claim 4 wherein said Bisphenol initiated compound contains in its structure oxyethylene groups and groups selected from oxybutylene and oxypropylene groups and a nucleus of Bisphenol A containing a plurality of reactive hydrogen atoms; the compounds being characterized in that the oxybutylene or oxypropylene groups are present in chains that are attached to the Bisphenol A nucleus at the site of the reactive hydrogen atoms; the oxyethylene groups being attached to the polyoxybutylene or polyoxypropylene groups at the end opposite the end of said latter groups which are attached to the Bisphenol A nucleus.

8. The composition of claim 4 wherein said Bisphenol initiated compound contains in its structure oxyethylene groups and groups selected from oxybutylene and oxypropylene groups, and a nucleus of Bisphenol A containing a plurality of reactive hydrogen atoms; the compounds being characterized in that all of the oxyethylene groups are present in polyoxyethylene chains that are attached to the Bisphenol A nucleus at the site of the reactive hydrogen atoms; the oxybutylene or oxypropylene groups being attached to the oxyethylene groups at the end opposite the end of said oxyethylene groups which are attached to the Bisphenol A nucleus.

9. The composition of claim 4 wherein the oxyalkylene groups are a heteric mixture of $C_3$–$C_5$ oxyalkylene groups with oxyethylene groups.

10. The composition of claim 4 comprising about 1.0 to 15 percent of said oxyalkylene compound about 1.0 to 10 percent of said chlorine releasing compound 0 to about 60 percent conventional additives and about 15 to 98 percent water.

11. The composition of claim 10 wherein said $C_3$–$C_5$ oxyalkylene groups are oxypropylene groups.

12. The composition of claim 10 wherein said $C_3$–$C_5$ oxyalkylene groups are oxybutylene groups.

13. The composition of claim 11 wherein said chlorine releasing compound in sodium hypochlorite.

14. The composition of claim 12 wherein said chlorine releasing compound is sodium hypochlorite.

15. The composition of claim 10 wherein said Bisphenol initiated compound contains in its structure oxyethylene groups and groups selected from oxybutylene and oxypropylene groups and a nucleus of Bisphenol A containing a plurality of reactive hydrogen atoms; the compounds being characterized in that all of the oxybutylene or oxypropylene groups are present in chains that are attached to the Bisphenol A nucleus at the site of the reactive hydrogen atoms; the oxyethylene groups being attached to the polyoxybutylene or polyoxypropylene groups at the end opposite the end of said latter groups which are attached to the Bisphenol A nucleus.

16. The composition of claim 15 wherein said chlorine releasing compound is sodium hypochlorite.

17. The composition of claim 10 wherein said Bisphenol initiated compound contains in its structure oxyethylene groups, groups selected from oxybutylene or oxypropylene groups, and a nucleus of Bisphenol A containing a plurality of reactive hydrogen atoms; the compounds being characterized in that all of the oxyethylene groups are present in polyoxyethylene chains that are attached to the Bisphenol A nucleus at the site of the reactive hydrogen atoms; the oxybutylene or oxypropylene groups being attached to the oxyethylene groups at the end opposite the end of said oxyethylene groups which are attached to the Bisphenol A nucleus.

18. The composition of claim 17 wherein said chlorine releasing compound is sodium hypochlorite.

19. The composition of claim 17 wherein the oxyalkylene groups are heteric mixture of oxyethylene groups with $C_3$–$C_5$ oxyalkylene groups.

20. The composition of claim 19 wherein said chlorine releasing compound is sodium hypochlorite.

21. A washing solution comprising about 0.1 to 0.5 percent of the composition of claim 10 balance water.

22. The washing solution of claim 21 wherein said $C_3$ to $C_5$ oxyalkylene groups are oxypropylene groups.

23. The washing solution of claim 21 wherein said $C_3$ to $C_5$ oxyalkylene groups are oxybutylene groups.

* * * * *